US006733377B2

(12) United States Patent
Adachi et al.

(10) Patent No.: US 6,733,377 B2
(45) Date of Patent: May 11, 2004

(54) DICING MACHINE

(75) Inventors: Tadashi Adachi, Mitaka (JP); Masayuki Azuma, Mitaka (JP); Takayuki Kaneko, Mitaka (JP)

(73) Assignee: Tokyo Seimitsu Co., Ltd., Mitaka (JP)

( * ) Notice: Subject to any disclaimer, the term of this patent is extended or adjusted under 35 U.S.C. 154(b) by 62 days.

(21) Appl. No.: 10/131,140

(22) Filed: Apr. 25, 2002

(65) Prior Publication Data

US 2002/0158158 A1 Oct. 31, 2002

(30) Foreign Application Priority Data

Apr. 27, 2001 (JP) ..... 2001-131714

(51) Int. Cl.[7] ..... B24B 55/00
(52) U.S. Cl. ..... 451/455; 125/13.01
(58) Field of Search ..... 83/169, 478, 481; 451/451, 455; 125/13.01, 23.01, 11.22, 14, 20; 409/134

(56) References Cited

U.S. PATENT DOCUMENTS 4,999,895 A * 3/1991 Hirose et al. ..... 409/134
5,342,156 A * 8/1994 Baba ..... 451/451
5,435,675 A * 7/1995 Rutschle ..... 451/455
5,531,004 A * 7/1996 Ahn ..... 409/134
5,603,851 A * 2/1997 Noda et al. ..... 219/69.12
5,971,679 A * 10/1999 Kim ..... 409/134
6,105,567 A * 8/2000 Sun et al. ..... 125/13.01
6,358,115 B1 * 3/2002 Koike et al. ..... 125/13.01

* cited by examiner

*Primary Examiner*—Stephen Choi
(74) *Attorney, Agent, or Firm*—Nixon Peabody LLP; David S. Safran

(57) ABSTRACT

The dicing machine has a shielding plate movably arranged between a processing part and a microscope so as to check mist and spray produced from the processing part. The shielding plate can be moved back and forth between a shielding position and a retreated position, so that the shielding plate is positioned at the shielding position during processing of the work and at the retreated position when the operator replaces the old blade with a new one. Thus, even if the dicing machine has two spindles facing to each other, the shielding plate does not interfere with replacement of blades on the spindles.

4 Claims, 7 Drawing Sheets

DICING MACHINE

BACKGROUND OF THE INVENTION

1. Field of the Invention

The present invention relates to a dicing machine, and more specially, to a dicing machine which provides a shielding plate between a processing part and an imaging device.

2. Description of the Related Art

FIG. 7 is a side view of a processing part of a conventional dicing machine, where a rotating blade 21 processing a work W is attached to an end of a spindle, in which a high frequency motor (not shown) is built. The work W is loaded on a work table 31, which moves along an X direction in FIG. 7 to cut the work W with the rotating blade 21. During the cutting, a large amount of water is applied to the rotating blade 21 through a cutting solution nozzle and a coolant nozzle (not shown), and the processing part 20 is filled with spray and mist of the water. Next to the processing part 20, there is provided an imaging device 10 including a microscope 11 to capture an image of the work W in order to align the work W. Between the processing part 20 and the microscope 11, a stationary shielding wall 71A is arranged to prevent the mist and spray in the processing part 20 from spattering on the microscope 11. A pre-washing nozzle 26 and an air curtain nozzle 27 are provided beside the bottom part of the shielding wall 71A, and an air curtain produced by the air curtain nozzle 27 prevents the mist from entering through an opening under the bottom of the shielding wall 71A.

The stationary shielding wall 71A is fixed on a wall (not shown) that is at the rear of the processing part 20. For this reason, when the operator changes the blade 21 to a new one with tools in both hands, there is a problem that the shielding wall 71A interferes with replacement of the blade 21. In recent years, a dicing machine called a twin dicing machine has come into the spotlight in which two spindles with two rotating blades are arranged so as to face each other. In the twin dicing machine, this problem is clearer and should be solved because the operator needs to reach around the rotating blade with his or her hands from the rear side to the front side of the spindles in order to change the blade on the front spindle.

SUMMARY OF THE INVENTION

In view of the foregoing, it is an object of the present invention to provide a dicing machine in which a shielding plate does not interfere with replacement of blades, even if two spindles on which the blades are attached are arranged to face to each other in a twin dicing machine.

In order to achieve the above-described object, the present invention is directed to a dicing machine, comprising: a processing part which processes a work with cutting solution; an imaging device which captures an image of a surface of the work; a shielding plate which prevents the cutting solution from sputtering on the imaging device, the shielding plate being movably arranged between the processing part and the imaging device; and a driving device which moves the shielding plate back and forth between a shielding position to cover the processing part and a retreated position to open the processing part.

According to the present invention, the shielding plate which can move back and forth is provided between the processing part and the imaging device, so that the shielding plate can check mist and spray due to splashing cutting solution and the shielding plate can be positioned at the retreated position in the case of being unnecessary.

Preferably, the shielding plate is positioned at the shielding position when the work is being processed, and the shielding plate is positioned at the retreated position when a blade provided in the processing part for processing the work is changed.

According to the present invention, the shielding plate is positioned at the retreated position when the operator changes the blade. Thus, when the operator replaces the old blade with a new one while using tools with both hands, the shielding plate does not interfere with replacement of the blades.

Preferably, the driving device comprises a closed moving-magnet air cylinder.

According to the present invention, even if the environment is filled with the cutting solution and mist, water does not enter the inside of the cylinder and the driving device does not break down.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Hereunder a preferred embodiment for a dicing machine of the present invention will be described in detail in accordance with the accompanying drawings.

Figure 1:
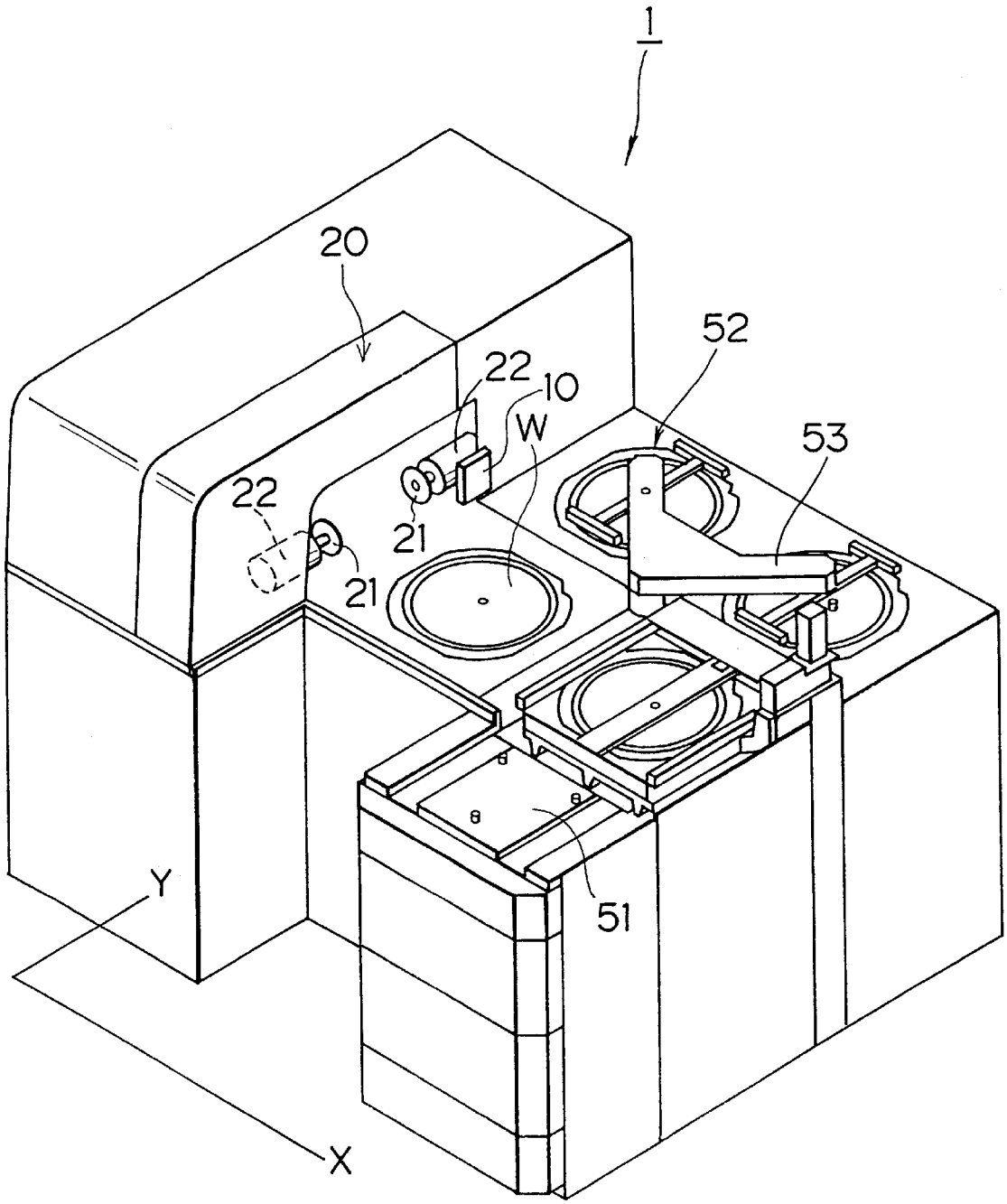
FIG. 1 is a perspective view showing an appearance of a dicing machine according to an embodiment of the present invention.

FIG. 1 is a perspective view showing an appearance of a dicing machine 1. In the dicing machine 1, an imaging device 10 captures an image of the surface of a work W in order to align the work W by pattern matching and to check a processing quality of a processed work W. A processing part 20 has spindles 22, in which high frequency motors (not shown) are built, and rotating blades 21 are attached to ends of the spindles 22. The processing part 20 also has a work table (not shown), which sucks and holds the work W. A washing part 52 washes the processed work W while spinning. On a load port 51, a cassette containing many works W is loaded. A transporting device 53 transports the work W between the above-described parts. The spindles 22 are arranged on a straight line in Y direction in FIG. 1 so as to face to each other. In the processing part 20 shown in FIG.

Figure 2:
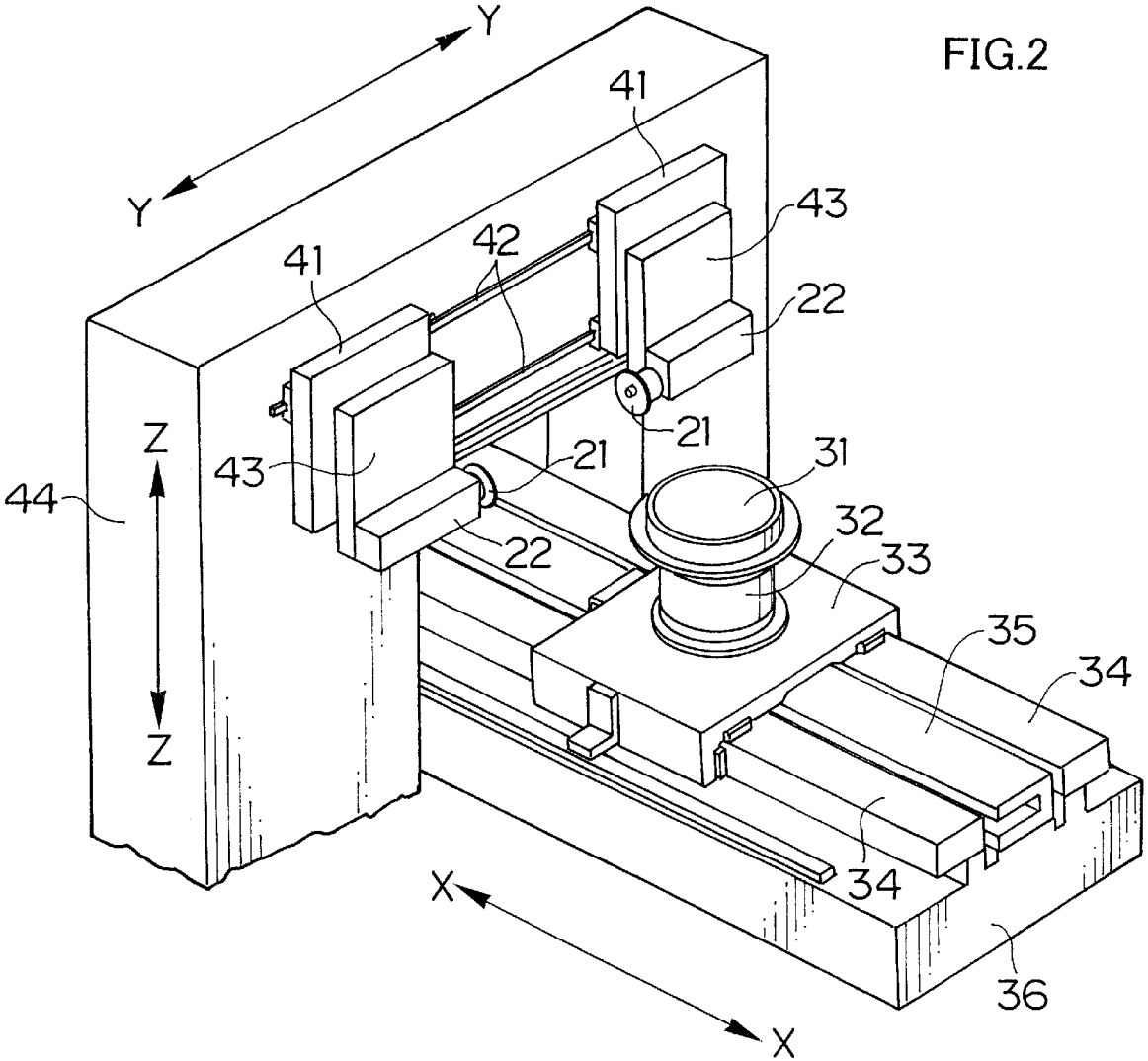
FIG. 2 is a perspective view showing a structure of a processing part of the dicing machine in FIG. 1.

2, an X table 33 is guided by X guides 34, which are provided on an X base 36, and is driven by a linear motor 35 along the X direction in FIG. 2. A work table 31 is provided on the X table 33 through a rotating table 32, which rotates in a θ direction. Y tables 41 are guided by Y guides 42 on a side of a Y base 44, and are driven by a stepping motor and a ball screw (not shown) along the Y direction in FIG. 2. Z tables 43 are arranged on the Y tables 41, and are driven by driving devices (not shown) along the Z direction. The spindles 22 with the built-in high frequency motors (not shown) are attached on the Z tables 43, and the rotating blades 21 are attached to the ends of the spindles 22. As the composition of the processing part 20 described above, the rotating blades 21 can move along the Y direction for indexing and along the Z direction in depth, and the work table 31 moves along the X direction for cutting.

Figure 3:
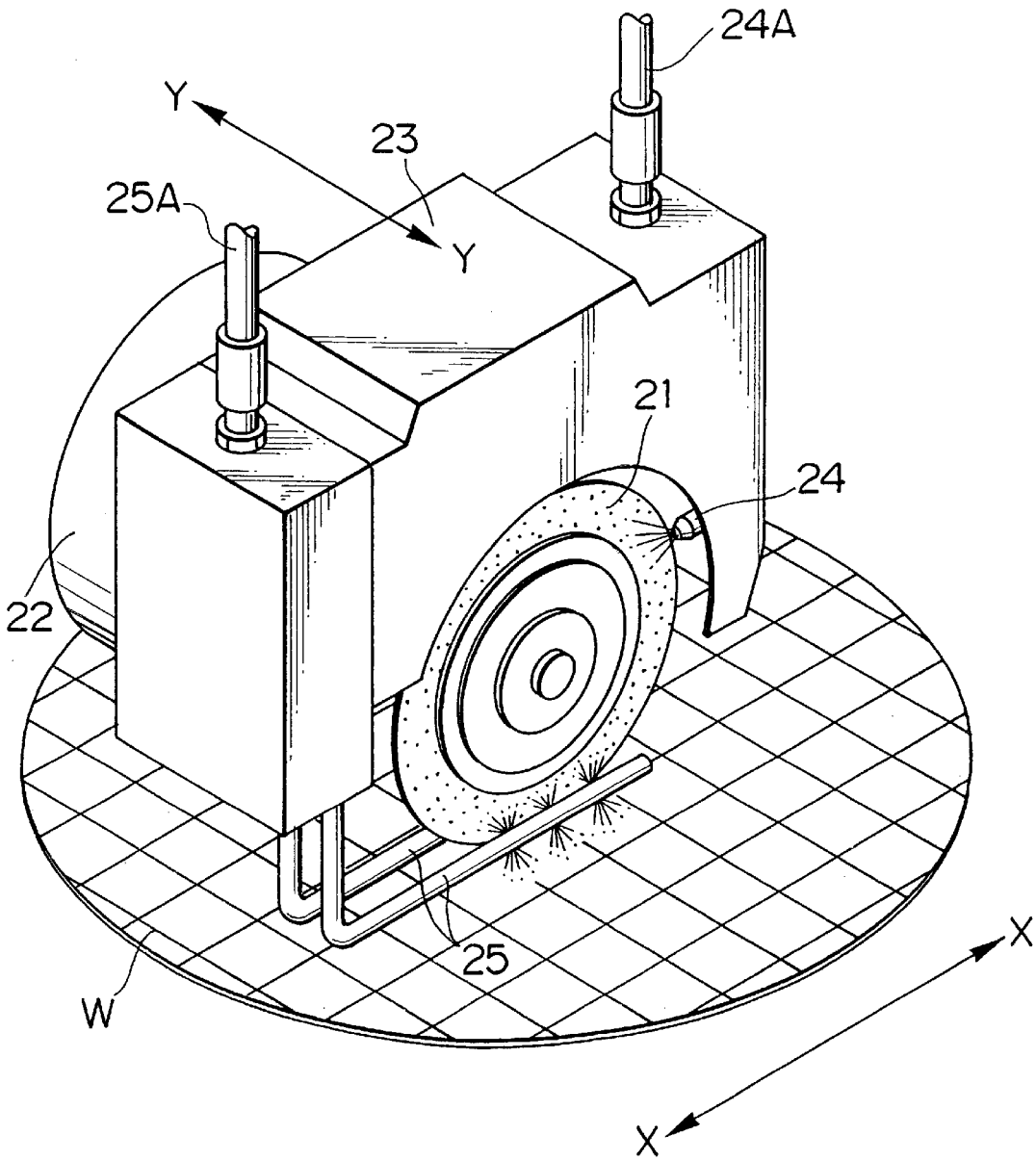
FIG. 3 is a perspective view showing construction around a rotating blade in the dicing machine.

Next, construction around the rotating blade is explained with reference to FIG. 3. In FIG. 3, the rotating blade 21 which is attached to the end of the spindle 22 in which the high frequency motor is built is covered with a flange cover 23 that has an opening part on the front face and at the lower part. In the flange cover 23, a cutting solution nozzle 24 and a pair of coolant nozzles 25, which are arranged between a front side and a rear side (spindle side) of the blade 21, are provided. The cutting solution nozzle 24 is connected with a supplying pipe for cutting solution 24A in the flange cover 23, and the pair of coolant nozzles 25 are connected with a supplying pipe for coolant 25A. The cutting solution is applied to an edge of the rotating blade 21 from the cutting solution nozzle 24, and the coolant is applied to the front and rear sides of the rotating blade 21 from the coolant nozzles 25.

Figure 4:
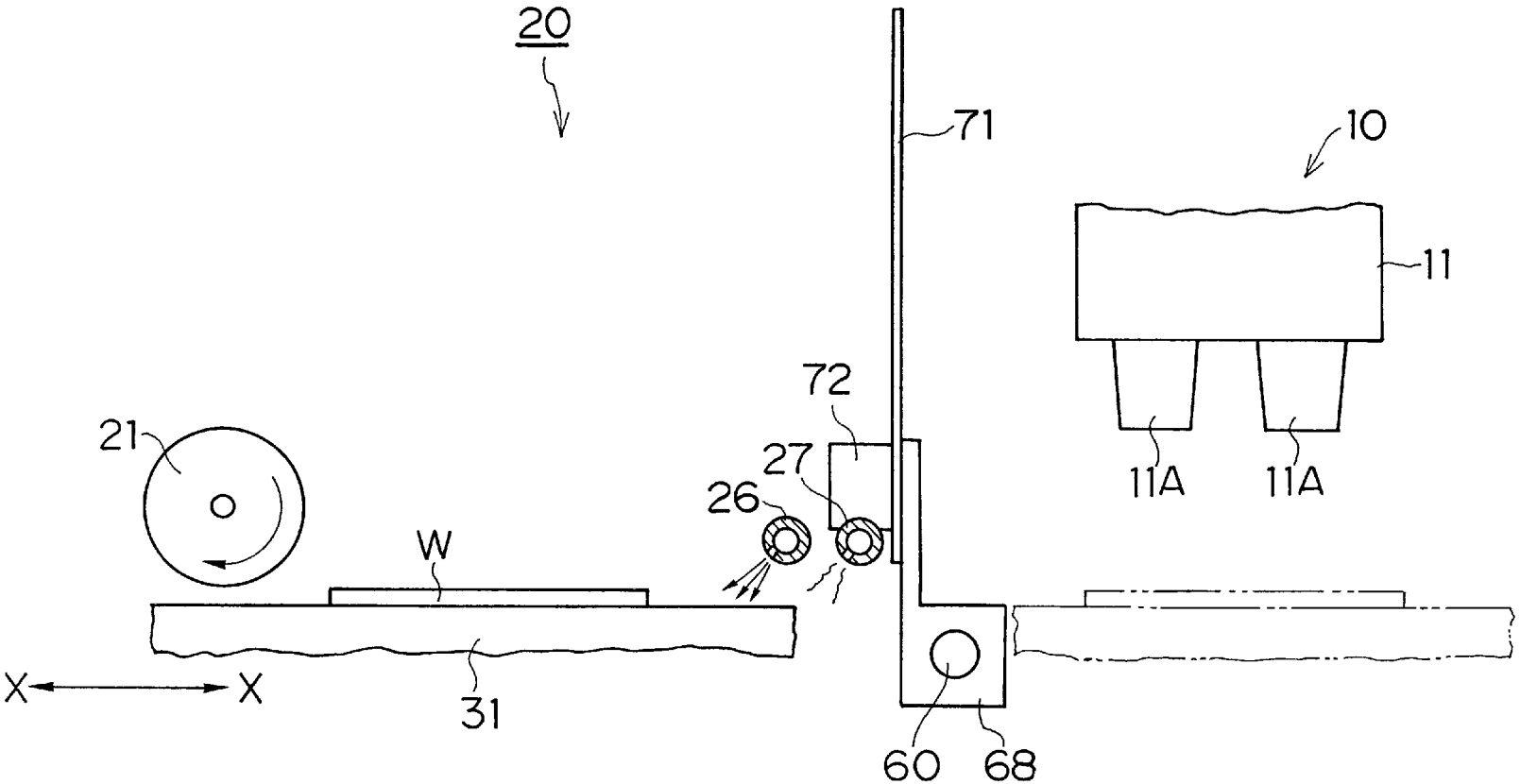
FIG. 4 is a front view showing construction around a shielding plate in the dicing machine.
Figure 5:
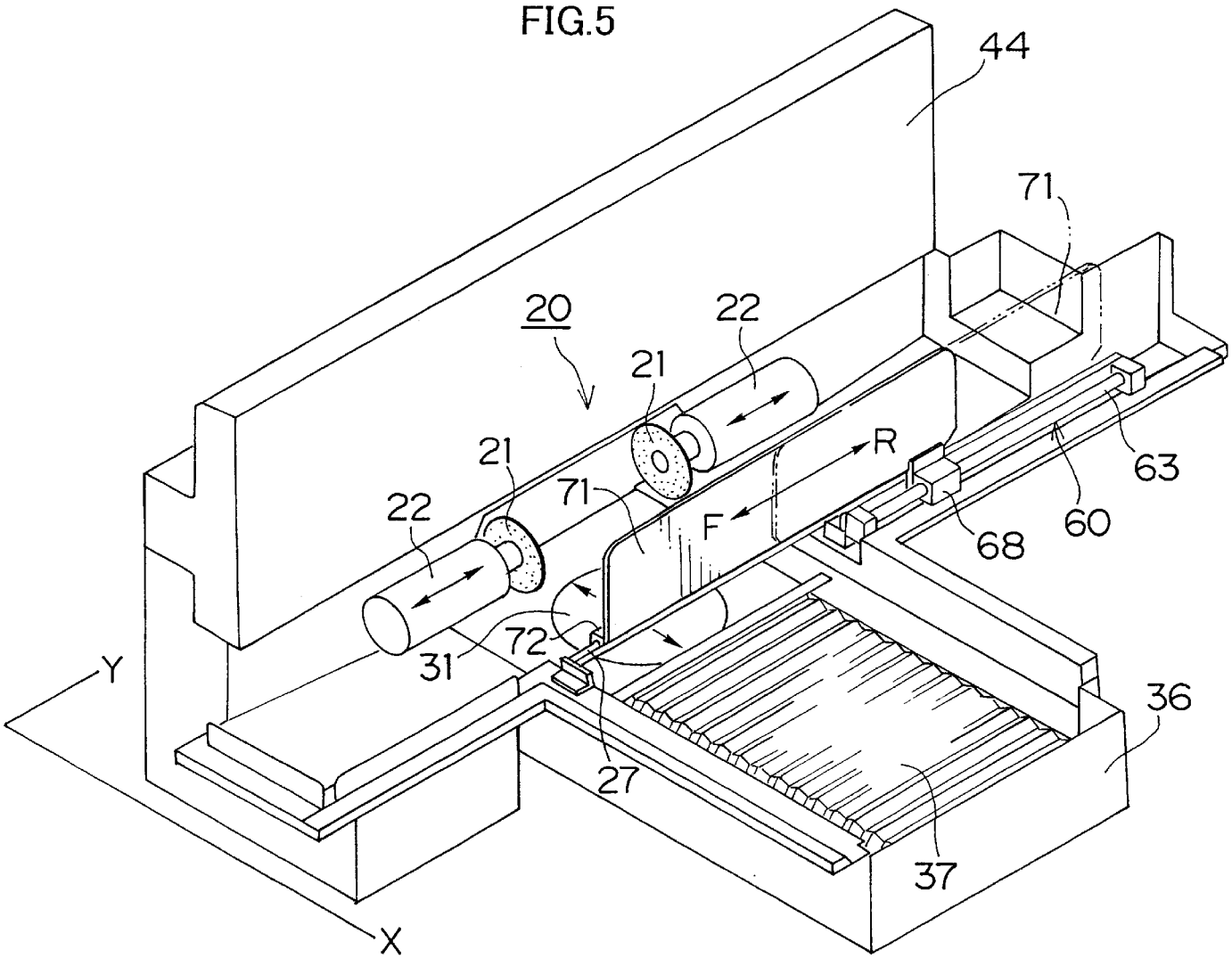
FIG. 5 is a perspective view showing construction around the shielding plate.

Next, construction around a shielding plate according to the present invention is explained with reference to FIGS. 4 and 5. The rotating blades 21 (one of them is shown in FIG. 4) rotate fast in the processing part 20, and the cutting solution and the coolant are applied to the rotating blades 21 from the cutting solution nozzle 24 and the coolant nozzles 25 as described above. The work W loaded on the work table 31 moves along the X direction in FIG. 4 for cutting. Outside the processing area (right-hand side of the rotating blade 21 in FIG. 4), two pipes having openings obliquely below are arranged side by side. The pipe of the left-hand side is a pre-washing nozzle 26, which applies washing water through the openings, and the pipe of the right-hand side is an air curtain nozzle 27, which applies air through the openings. Next to the processing part 20, an imaging device 10 is arranged. The imaging device 10 captures an image of the surface of the work W in order to align the work W by pattern matching before processing and to check a processing quality of the processed work W. The imaging device 10 comprises a microscope 11 where object lenses 11A are arranged at the bottom of the microscope 11, a CCD camera (not shown), which captures an enlarged image of the surface of the work W and transforms the image into an electrical signal. A shielding plate 71 is provided between the processing part 20 and the microscope 11 in order to prevent mist and spray that are produced in the processing part 20 from sputtering on the microscope 11 and the object lenses 11A of the microscope 11. The shielding plate 71 is fixed to a slide block 68 of a moving-magnet air cylinder 60 and slides on the air curtain nozzle 27 as the guide rail through the guide block 72. In FIG. 5, the moving-magnet air cylinder 60 is arranged at the inner part of the X base 36, and the slide block 68 sliding on a cylinder 63 of the moving-magnet air cylinder 60 is connected to the bottom of the rear side of the shielding plate 71. The guide block 72 is attached to the bottom of the front side of the shielding plate 71. The shielding plate 71 is driven to a shielding position F when the slide block 68 of the moving-magnet air cylinder 60 is positioned to an advanced end, and is driven to a retreated position R when the slide block 68 of the moving-magnet air cylinder 60 is positioned to a backward end. A bellow 37 is provided to the bottom of the block position F of the shielding plate 71, and covers the X guide part.

Figure 6:
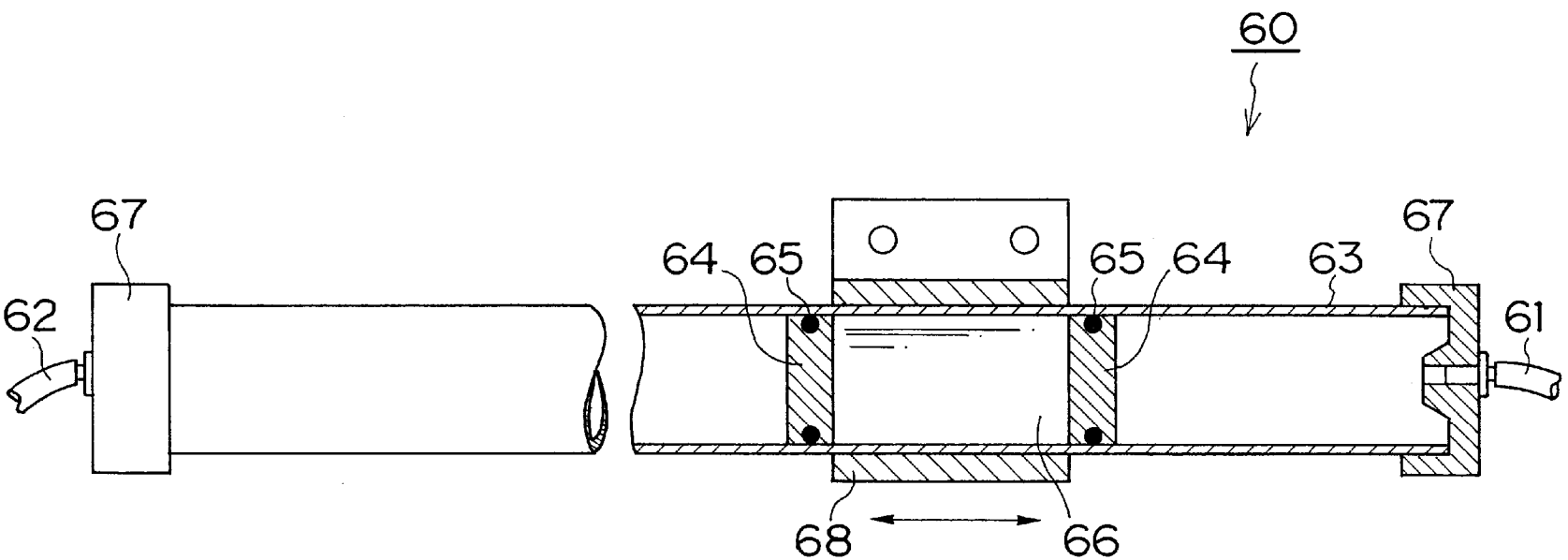
FIG. 6 is a partially sectional view showing a structure of a moving-magnet air cylinder in a moving device for the shielding plate.
Figure 7:
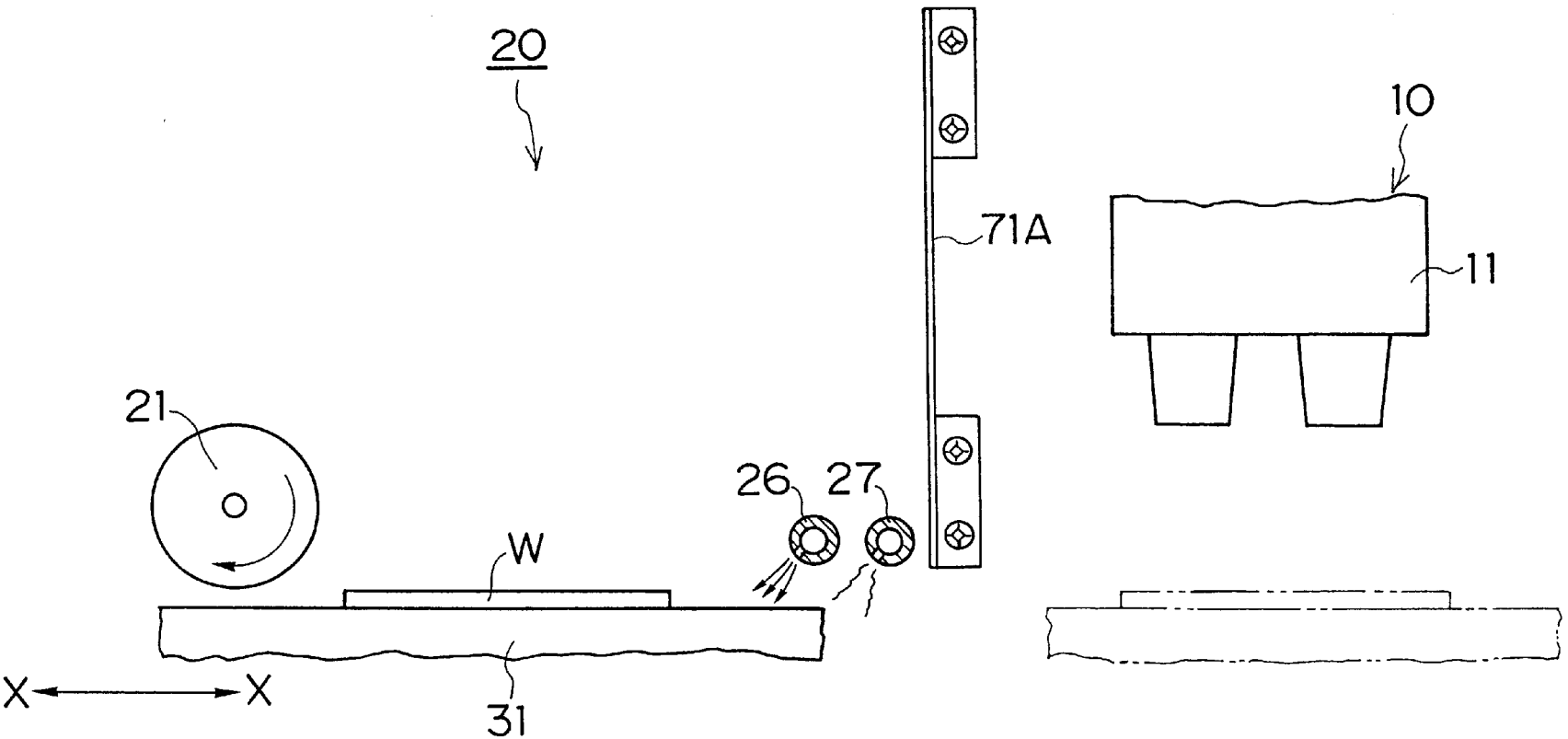
FIG.7 PRIOR ART
FIG. 7 is a front view showing construction around a conventional shielding wall.

In FIG. 6, the structure of the moving-magnet air cylinder 60 is shown. The moving-magnet air cylinder 60 has the cylinder 63 as a body, which is made of a material of low magnetic permeability, for example, an alloy of aluminum or a resin. Two sliders 64 which have recesses at the periphery parts are attached to the both ends of a magnet 66 in the cylinder 63. O rings 65 are attached in the recesses of the sliders 64 at the periphery parts, respectively, and the magnet 66 and the sliders 64 slide in the cylinder 63 while being sealed with the O rings 65. Covers 67 are attached to the both ends of the cylinder 63. A front side air tube 62 is connected to the cover of the front side (left-hand side in FIG. 6) and a rear side air tube 61 is connected to the cover of the rear side (right-hand side in FIG. 6). The slide block 68 composed of a ferromagnetic substance or a material of high magnetic permeability (e.g., a permalloy) is slidably arranged on the periphery of the cylinder 63. The slide block 68 can be slid between the front side and the rear side by the magnetic force of the magnet 66 when the magnet 66 is moved.

Operations of the dicing machine 1 which is comprised as described above are explained. First, the cassette in which many works W are received is loaded on the load port 51. The work W is pulled out of the cassette by the transporting device 53 and loaded on the work table 31, and is then transported to the processing part 20. In the middle of transporting, the CCD camera captures an image of the surface of the work W, and the work W is aligned by the pattern matching.

In the moving-magnet air cylinder 60, which is arranged inside the X base 36, compressed air is supplied from the rear side air tube 61 and the front side air tube 62 is opened according to changing of electric valves (not shown) so that the magnet 66, which is bonded to the sliders 64, moves to the advanced end of the front side. The slide block 68 moves to the advanced end while the magnet 66 moves to the advanced end of the front side, so that the shielding plate 71 slides on the air curtain nozzle 27 and is positioned to the shielding position F represented with solid lines in FIG. 5.

In the processing part 20, the rotating blades 21, which rotate fast, are moved along the Y direction, and are positioned to the first process lines. Next, the cutting solution is applied to the edges of the blades 21 through the cutting solution supplying pipes 24A and the cutting solution nozzles 24, and the coolant is applied to the sides of the blades 21 through the coolant supplying pipes 25A and the coolant nozzles 25. The cutting solution applied to the edges of the rotating blades 21 is supplied to processing points along the rotating blades 21. The coolant applied to the both sides of the rotating blades 21 from the coolant nozzles 25 prevents the processing heat from raising the temperature of the rotating blades 21. In this state described above, the work W moves along the X direction for cutting so that the first lines are processed. Next, the rotating blades 21 are moved by one pitch along the Y direction for indexing so that next lines are processed in turn.

Because the blades 21 rotate fast (e.g., at 60,000 revolution per minute) and a large mount of cutting solution and coolant is supplied to the rotating blade 21, the processing part 20 is filled with spray and mist of the water. However, the shielding plate 71 is positioned at the shielding position F, and the shielding plate 71 prevents the spray and mist from sputtering on the microscope 11. Moreover, an air curtain produced by the air curtain nozzle 27 prevents the mist from entering through an opening under the bottom of the shielding plate 71, and the object lenses 11A of the microscope 11 are not misted. The bellow 37 protects the X guide part.

When the processing for the work W is finished, the work W is moved under the pre-washing nozzle 26 and preparatorily washed with the washing water, and the transporting device 53 then transports the work W to the washing part 52, where the work W is washed while spinning. The work W having been washed is returned to the cassette as before by the transporting device 53. The flow of one work W which is processed by the dicing machine 1 is described above.

In the case that many works have been processed, it is necessary that the rotating blades 21 are replaced with new ones because the rotating blades 21 are worn down or chipped. Then, the operator changes the rotating blades 21 to new ones with tools. At this time, the compressed air is supplied from the front side air tube 62 of the moving-magnet air cylinder 60 and the rear side air tube 61 is opened so that the magnet 66 is moved to the backward end of the rear side. The shielding plate 71 is thereby positioned to the retreated position R represented with alternate long and two short dashes line in FIG. 5 while the magnet 66 moves to the backward end of the rear side, so that the side of the rotating blades 21 is opened. Then, the operator can exchange the rotating blades 21 in the large space without the shielding plate 71.

According to the present invention, in the case that the rotating blade 21 of the dicing machine 1 is changed, it is easy for the operator to work because the shielding plate 71 is positioned to the retreated position.

According to the present invention, the shielding plate which can move back and forth is provided between the processing part and the imaging device, and the shielding plate is positioned automatically to the retreated position when the operator replaces the old blade with a new one. Thus, even in the twin dicing machine in which the two spindles are arranged so as to face to each other, the shielding plate does not interfere with replacement of the blades.

Since the driving device by which the shielding plate moves back and forth is the closed cylinder, even if the environment is filled with the spray and mist of the cutting solution and the coolant, the water does not enter the inside of the cylinder and the driving device does not break down.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A dicing machine, comprising:

a processing part which processes a work with cutting solution;

an imaging device which captures an image of a surface of the work;

a shielding plate which prevents the cutting solution from sputtering on the imaging device, the shielding plate being movably arranged between the processing part and the imaging device;

an air curtain nozzle which produces an air curtain for preventing a mist of the cutting solution from passing through an opening under a bottom of the shielding plate, the air curtain nozzle also serving as a guide rail for the shielding plate; and a driving device which slides the shielding plate on the air curtain nozzle back and forth between a shielding position to cover the processing part and a retreated position to open the processing part.

2. The dicing machine as defined in claim 1, wherein the driving device comprises a closed moving-magnet air cylinder.

3. The dicing machine as defined in claim 1, wherein the shielding plate is positioned at the shielding position when the work is being processed, and the shielding plate is positioned at the retreated position when a blade provided in the processing part for processing the work is changed.

4. The dicing machine as defined in claim 3, wherein the driving device comprises a closed moving-magnet air cylinder.

* * * * *